United States Patent [19]

Albers et al.

[11] Patent Number: 4,967,829

[45] Date of Patent: Nov. 6, 1990

[54] HEAT AND MASS TRANSFER RATES BY LIQUID SPRAY IMPINGEMENT

[75] Inventors: Walter F. Albers, 2626 E. Arizona Biltmore Cir., #23, Phoenix, Ariz. 85016; James R. Beckman, Tempe; Frank R. Myers, Mesa, both of Ariz.

[73] Assignee: Walter F. Albers, Phoenix, Ariz.

[21] Appl. No.: 130,305

[22] Filed: Dec. 9, 1987

[51] Int. Cl.[5] ..... F28F 13/02; F28F 13/12

[52] U.S. Cl. ..... 165/1; 165/109.1; 165/111; 165/908; 261/118; 261/153

[58] Field of Search ..... 165/109.1, 908, 111, 165/1; 261/115, 118, 153

[56] References Cited

U.S. PATENT DOCUMENTS

| | | | |
|---|---|---|---|
| 3,199,212 | 8/1965 | Foure | 165/1 |
| 3,205,147 | 9/1965 | Foure et al. | 165/1 |
| 3,274,752 | 9/1966 | Huyghe et al. | 165/1 |
| 4,037,653 | 7/1977 | Meissner et al. | 165/1 |
| 4,832,115 | 5/1989 | Albers et al. | 165/111 |

*Primary Examiner*—Albert W. Davis, Jr.

*Attorney, Agent, or Firm*—William W. Holloway

[57] ABSTRACT

On a surface on which heat is exchanged with a gas media, the heat transfer coefficient can be enhanced by directing a spray at the surface. The spray droplets can disrupt the stagnant air layer adjacent to the exchange surface, can increase the area for heat and mass transfer and can aid in carrying vapor from the gas media to the exchange surface.

12 Claims, 1 Drawing Sheet

HEAT AND MASS TRANSFER RATES BY LIQUID SPRAY IMPINGEMENT

RELATED APPLICATION

The following U.S. patent application is a related application to the present invention:

METHOD AND APPLICATION FOR SIMULTANEOUS HEAT AND MASS TRANSFER, invented by W. F. Albers and J. R. Beckman, having Ser. No. 06/883,734, filed Oct. 27, 1986 and assigned to the assignee of the present application.

BACKGROUND

Heat exchanger units tend to be large and therefore costly in the service of gas heating or cooling and evaporation and/or condensation of volatile liquids in the presence of a non-condensible gas. The problem with the heat exchange units is poor heat and mass transfer coefficients in the interaction with the heat exchange surfaces. It is known that heat transfer coefficients for gases, as well as heat and mass transfer coefficients for evaporation and condensation in the presence of a non-condensible gas, are low. The low transfer coefficients are due to the difficulty of the conduction of heat and the diffusion of particle components through the stagnant gas boundary layer associated with the transfer surfaces. As an example, addition of a non-condensable gas to a condenser has been shown to reduce drastically heat transfer coefficients as reported by D. F. Othmer, "The Condensation of Steam", I+EC, 21, 1929, No. 6, pages 576–583 describing the results of a series of experiments involving known amounts of air in a steam condenser. The results suggest that a film of non-condensable gas and vapor collects about the condensate film requiring that steam diffuse through the stagnant layer of air before condensing on the surface. Heretofore, the methods of improving the heat transfer rate for a gas or for evaporation and condensation in the presence of a non-condensable gas have involved enlarging the transfer area with fins and other shapes or by increasing transfer coefficients by greater gas phase velocity, thereby causing gas phase pressure drop. Both methods are costly solutions to a difficult problem.

A need has therefore been felt for increasing the heat transfer rate for a gas and for evaporation and condensation in the presence of a non-condensible gas at a transfer surface.

It is therefore a feature of the present invention to provide apparatus and technique for enhancing the heat transfer coefficents between a gas and heat transferring surface.

SUMMARY OF THE INVENTION

The foregoing and other features are accomplished, according to the present invention, by improving heat transfer coefficients for gases, and heat and mass transfer coefficients for evaporation and condensation in the presence of a non-condensable gas, at a heat transfer surface by increasing the degree of turbulence in the vicinity of the stagnant gas layer adjacent to the transfer surface. Increased turbulence is accomplished by use of liquid droplets sprayed onto the transfer surface. The spray droplets serve multiple functions: first, the droplets draw vapor from the bulk gas phase to the wet transfer surface thus aiding the diffusion process; second, the droplets disturb the gas boundary layer present at the interface which improves both heat and mass transfer coefficients by increasing turbulence at the gas-liquid interface; and third, the spray droplets provide increased area for heat and mass transfer as they move through the bulk gas phase. All of these functions improve the ability of the gas to exchange heat, thereby potentially reducing the size and cost of necessary heat exchange units.

These and other features of the present invention will be understood upon reading of the following description along with the drawings.

DETAILED DESCRIPTION OF THE INVENTION

Figure 1:
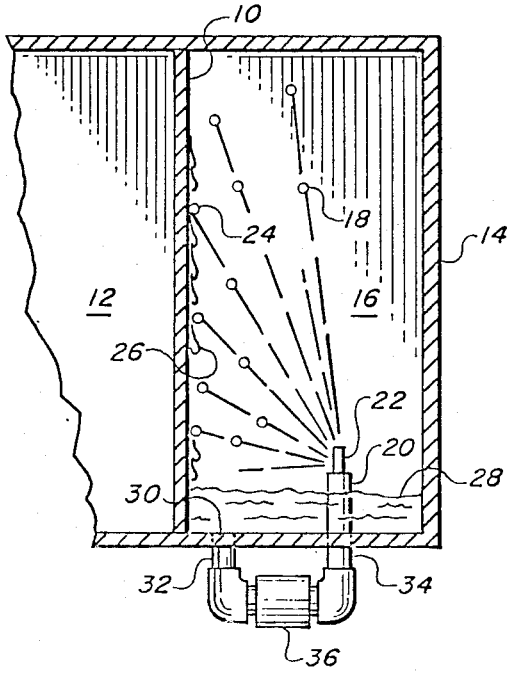
FIG. 1 is a cross sectional view of a chamber connected to a heat reservoir for gas heating or cooling and for condensation or evaporation in the presence of a gas utilizing spray drop impingement.

Referring first to FIG. 1, heat transfer partition 10 is shown as a vertical wall which can be constructed of metals or plastics and can be of any shape. The heat transfer partition 10 is thermally coupled on a first side to heat reservoir 12. Heat reservoir 12 can supply heat to or remove heat from heat transfer partition 10. Walls 14, which are not necessary for heat transfer and can be fabricated from any suitable conducting or non-conducting material, attach to partition 10 along its longitudinal length in a manner to form a chamber. The chamber has an opening open at each end, thereby allowing a directional movement of gas 16 through the chamber. Liquid spray droplets 18 are supplied from distributor 20. Distributor 20 can be a pipe to which are attached spray nozzles 22, although other means of spray generation may be utilized. The location of distributor 20 or multiple distributors 20 can be at various locations within the space confined by partition 10 and walls 12, provided that the spray travels through the gas 16 a non-negligible distance before Impingement 24 upon heat transfer partition 10. Surface liquid film 26, the accumulation on heat transfer partition 10 of liquid spray 18, travels by gravity on heat transfer partition 10 and can accumulate in basin 28 or other liquid collection means. In conditions where fresh liquid is constantly supplied to heat transfer partition 10, basin 28 can be drained via port 30 and pipe 32, and fresh liquid intake supplied to distributor 20 by means of pipe 34. In cases where partial or complete liquid recycle is desired, pipes 32 and 34 may be connected by pump assembly 36.

A selected property of gas 16, the temperature, can be caused to change by either heating or cooling of the gas 16 depending on the temperature of heat reservoir 12, as the gas 16 moves through the chamber bounded by partition 10 and walls 14. Another selected property of gas 16, its composition, can also change by either evaporation or condensation of liquid droplets 18 and film 26 into or out of the gas 16 as the gas is heated or cooled, when there is an imbalance in the vapor pressure of the liquid with the partial pressure of the volatile liquid in gas 16. This evaporation of a liquid to a vapor or condensation of a vapor to a liquid is a phase change. If the liquid has little or no vapor pressure such as an oil, molten salts or molten metal, or if the liquid vapor pressure is equal to the partial pressure of the liquid in the gas (such as is possible with some balances using desiccants), then substantially no evaporation or condensation, i.e., substantially no phase change to the liquid, can occur when gas 16 is forced to be either cooled or heated by the temperature of heat reservoir 12.

According to one mode of operation, when heat reservoir 12 is cooler than gas 16, then gas 16 will be cooled by the loss of energy from the chamber bounded by partition 10 and walls 14, the energy being absorbed through partition 10 in response to heat reservoir 12. If liquid film 26 and droplets 18 are comprised of oil or equal vapor and partial pressure desiccant(s), then gas 16, upon cooling, will provide substantially no condensation of vapors in the gas chamber. If the liquid film 26 and droplets 18 are comprised of a volatile liquid with imbalances of vapor and partial pressure, then vapor will condense as gas 16 cools.

Conversely, when the heat reservoir 12 is warmer than gas 16, gas 16 will be heated by energy conducted through partition 10 from heat reservoir 12. If liquid film 26 and droplets 18 are of oil or equal vapor and partial pressure desiccant(s), then gas 16, upon heating, will cause no evaporation of liquids into the vapor space When the liquid film 26 and droplets 18 are of a volatile liquid with imbalances of vapor and partial pressure, then liquid will evaporate as gas 16 heats.

As an example of a change in a selected property of a gas with no phase change in a liquid and, also, as an example of an enhanced gas heat transfer coefficient generation resulting from the spray impingement technique, a three inch wide chamber with a gas velocity of 0.1 feet per second was forced to change temperature by a sprayed desiccant (LiCl/water) in such a way so as no evaporation or condensation occurred. The gas heat transfer coefficient generated was 18 Btu's per square foot of partition area per hour per degree F. This gas heat transfer coefficient compares to a coefficient of less than 1 Btu per square foot per hr. per degree F. when no spray action were present.

Figure 2:
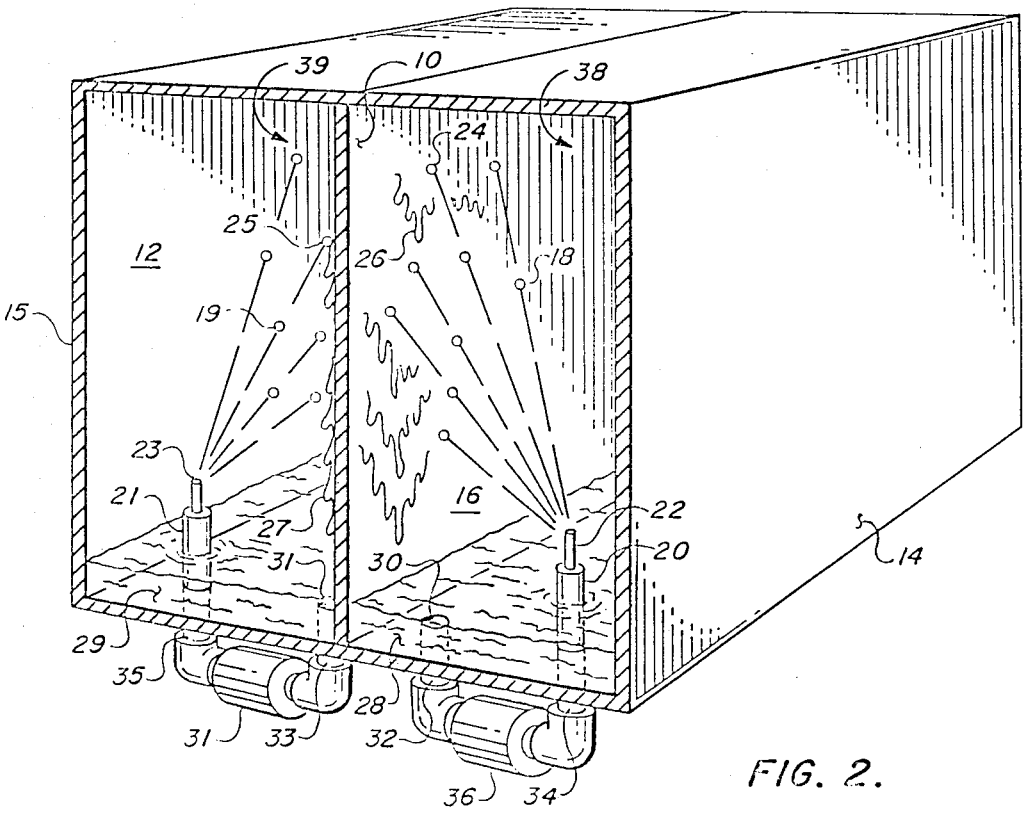
FIG. 2 is a perspective view of two chambers in heat exchange relationship for gas heating or cooling and for condensation or evaporation in the presence of gases utilizing spray drop impingement.

Referring next to FIG. 2, the apparatus for a first chamber is similar to the chamber with gas 16 described above. The general heat reservoir 12 of FIG. 1 is now specified as a similar spray chamber bounded by and thermally coupled to heat transfer partition 10. Walls 15 bound partition 10 along its longitudinal length in a manner to form a chamber which is open at each end, thereby allowing a directional movement of gas 17 within the chamber. Liquid spray droplets 19 are supplied from distributor 21 which is shown as a pipe to which are attached spray nozzles 23. The spray nozzles 23 are positioned in a manner that provides for spray droplet travel through the gas space before impingement 25 upon heat transfer partition 10. Liquid film 27, the accumulation on heat transfer partition 10 of liquid spray 19, travels by gravity on heat transfer partition 10 and can accumulate in basin 29 or other liquid collection means. When fresh liquid is constantly supplied to heat transfer partition 10, basin 29 may be drained via port 31 and pipe 33 with fresh liquid intake supplied to distributor 21 by means of pipe 35. In cases where partial or complete liquid recycle is desired, pipes 33 and 35 may be connected by pump assembly 37.

As in the case of chamber 38, defined by heat transfer partition 10 and walls 14, in chamber 39 defined by the heat transfer partition 10 and walls 15, a selected property of gas 17, its temperature, can be caused to change by either the heating or cooling of the gas 17, depending on the temperature of chamber 38 as the gas 17 moves through chamber 39. Another selected property of gas 17, its composition, can also change by a phase change involving the liquid either by evaporation or condensation of materials comprising the liquid droplets 19 and film 27, into or out of the gas 17, as the gas 17 is heated or cooled when there is an imbalance in the vapor pressure of the liquid with the partial pressure of the volatile liquid in gas 17. When the liquid has little or no vapor pressure or when the liquid vapor pressure is equal to the partial pressure of the liquid in the gas, then substantially no evaporation or condensation, i.e., no phase change involving the liquid, can occur when gas 17 is forced to cool or heat by the temperature of chamber 38. In other configurations, a number of alternate chambers 38 and 39 may be thermally coupled by a series of heat transferring partitions 10 which are exposed on opposite sides to fluids of the alternating chambers.

According to one mode of operation, hot gas 17 can enter chamber 39 where the gas 17 cools before exiting with substantially no evaporation or condensation occurring. Spray droplets 19, which may be an oil with substantially no vapor pressure resulting in substantially no liquid evaporation or condensation in chamber 39, allow only the cooling of gas 17. The energy released from chamber 39 during cooling is transferred to chamber 38 through heat transferring partition wall 10. Gas 16, entering chamber 38 and being colder than gas 17, absorbs the heat transferred through heat transferring partition 10. Thereby, gas 16 increases in temperature and, when droplets 18 are water for example, increases in humidity as droplets 18 and liquid film 26 evaporate into gas 16.

The process just described provides cooling of a first gas gas with heating and humidifying of a second gas gas. Other process operations can include the cooling of gas 17 with simultaneous heating of gas 16; cooling of gas 17 along with condensation resulting from its cooling into droplets 19 and liquid film 27 while heating gas 16 in chamber 38; and cooling of gas 17 along with condensation from the cooling into droplets 19 and liquid film 27 while heating and evaporation from liquid droplets 18 and liquid film 26 into gas 16.

The foregoing description is included to illustrate the operation of the preferred embodiment and is not meant to limit the scope of the invention. The scope of the invention is to limited only by the following claims, From the foregoing description, many variations will be apparent to those skilled in the art that would yet be encompassed by the spirit and scope of the invention.

What is claimed is:

1. Apparatus for changing at least one selected property of a first gas and at least one selected property of a second gas, said apparatus comprising:

a first chamber, said first chamber having a first gas stream flowing therethrough;

a first liquid;

a second chamber, said second chamber having said second gas flowing therethrough;

a second liquid;

a thermally conducting partition forming a wall of said first chamber and a wall of said second chamber, said thermally conducting partition permitting heat exchange between said first chamber and said second chamber;

first spray means for projecting first liquid droplets against said first chamber wall, wherein said first liquid droplets pass through said first gas before impinging upon said first chamber wall, said first liquid droplets forming a first liquid film on said first chamber wall, said first liquid droplets causing turbulence in a first gas layer proximate said first chamber wall; and second spray means for projecting second liquid droplets through said second gas against said second chamber wall, wherein a second liquid film is provided by said second liquid droplets impinging on said second chamber wall, said second liquid droplets causing turbulence in a second gas layer proximate said second chamber wall, conduction of heat between said first and said second chamber changing at least one selected property of said first gas and at least one selected property of said second gas.

2. The apparatus of claim 1 wherein said first liquid is selected to prevent substantial liquid first phase change in said first chamber.

3. The apparatus of claim 2 wherein said second liquid is selected to minimize second liquid phase change in said second chamber.

4. The apparatus of claim 2 wherein said selected property is a second gas temperature.

5. The apparatus of claim 2 wherein said selected property is a second gas composition.

6. The apparatus of claim 1 wherein said first liquid is selected to provide substantial first liquid phase change in said chamber.

7. The apparatus of claim 6 wherein said second liquid is selected to provide second liquid phase changes in said second chamber.

8. The apparatus of claim 6 wherein said selected property is a second gas temperature.

9. The apparatus of claim 6 wherein said selected property is a second gas composition.

10. The apparatus of claim 6 wherein said second liquid is selected to minimize second liquid phase change in said second chamber.

11. The apparatus of claim 1 wherein said selected property is a first gas temperature.

12. The apparatus of claim 1 wherein said selected property is a first gas composition.

* * * * *